US009021934B1

(12) United States Patent
Hagerty

(10) Patent No.: US 9,021,934 B1
(45) Date of Patent: May 5, 2015

(54) REMOTE WEAPON MOUNTED VIEWING AND SIGHTING SYSTEM

(71) Applicant: Matthew C. Hagerty, Sonora, CA (US)

(72) Inventor: Matthew C. Hagerty, Sonora, CA (US)

( * ) Notice: Subject to any disclaimer, the term of this patent is extended or adjusted under 35 U.S.C. 154(b) by 0 days.

(21) Appl. No.: 13/844,444

(22) Filed: Mar. 15, 2013

Related U.S. Application Data

(63) Continuation-in-part of application No. 11/429,353, filed on May 5, 2006, now abandoned, and a continuation-in-part of application No. 12/030,169, filed on Feb. 12, 2008, now abandoned, and a continuation-in-part of application No. 12/327,610, filed on Dec. 3, 2008, now abandoned.

(51) Int. Cl.
*F41G 3/14* (2006.01)
*F41G 3/18* (2006.01)

(52) U.S. Cl.
CPC ... *F41G 3/14* (2013.01); *F41G 3/18* (2013.01)

(58) Field of Classification Search
CPC ..... F41G 3/14; F41G 3/145; F41G 3/147; F41G 3/16; F41G 3/18
USPC ..... 89/41.05, 41.06
See application file for complete search history.

(56) References Cited

U.S. PATENT DOCUMENTS

| | | | | |
|---|---|---|---|---|
| 5,711,104 | A * | 1/1998 | Schmitz | 42/111 |
| 5,834,676 | A * | 11/1998 | Elliott | 89/41.05 |
| 8,336,777 | B1 * | 12/2012 | Pantuso et al. | 235/409 |
| 2006/0121993 | A1 * | 6/2006 | Scales et al. | 463/48 |

* cited by examiner

*Primary Examiner* — Stephen M Johnson

(57) ABSTRACT

A system is provided for deployment of sensors for surveillance and operational security which allows transmission of real time video (as well as high data rate sensor data) in a secure manner from remote locations. The system provides data linkage in a manner that resists interception and blockade without revealing either the origin or the destination of the data. Ultra wideband transmissions are used to transmit video data in a difficult to detect or intercept manner. A preferred use of the system is to wirelessly transmit images from a weapon site video camera to a wearable unit which displays the image directly to an operator. The system provides low latency video manipulation that enables a computer implemented sighting reticle that can be zeroed in a manner analogous to a traditional optical weapon sight.

4 Claims, 9 Drawing Sheets

REMOTE WEAPON MOUNTED VIEWING AND SIGHTING SYSTEM

CROSS-REFERENCE TO PRIOR APPLICATIONS

The present application is a continuation in part and claims priority to U.S. patent application Ser. No. 11/429,353, filed on May 5, 2006, and now abandoned; is a continuation in part and claims priority to U.S. patent application Ser. No. 12/030,169, filed on Feb. 12, 2008, and now abandoned; and is a continuation in part and claims priority to U.S. patent application Ser. No. 12/327,610, filed on Dec. 3, 2008, and now abandoned. All of the above applications are incorporated by reference into this current application.

U.S. GOVERNMENT SUPPORT

A portion of the development of the present invention was funded by SBIR 99-003 from the Department of Defense.

BACKGROUND

Area of the Art

The present invention is in the area of improved weapon sighting systems and more particularly relates to portable systems for wirelessly and securely streaming video and related data under battlefield conditions.

DETAILED DESCRIPTION OF THE INVENTION

Figure 1:
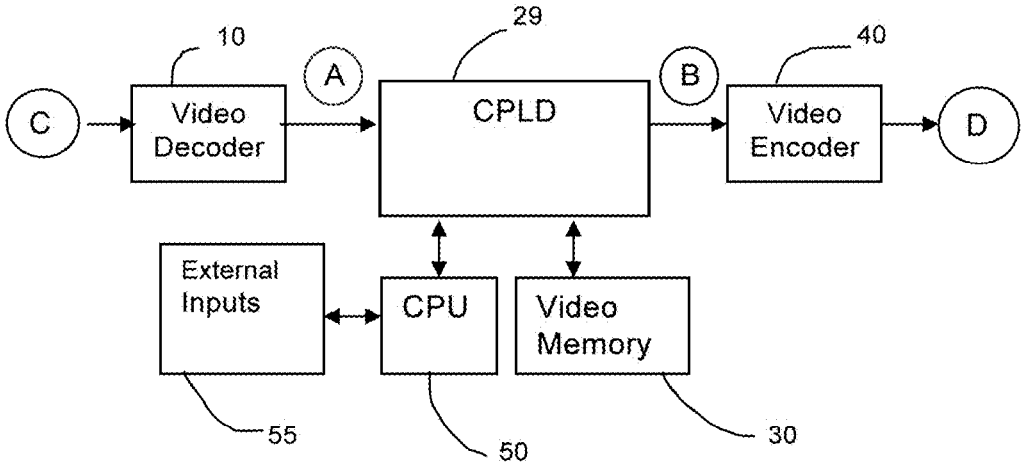
FIG. 1 shows a block diagram of the LLVC.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved remote video-based weapon sighting system.

Since 1999, the invention, called "SmartSight" by the inventor, A Remote Video Weapon Mounted Sighting System has undergone continual and extensive research and development by the Principal Investigator, Mr. Matthew C. Hagerty of LandTec, Inc. For example, the device began as a wired system and is evolving into a wireless system. This application describes the wired system.

The Remote Weapon Mounted Sighting System consists of three primary components:

1). A waterproof Camera Module mounted on a weapon;

2). A waterproof Operator Module (CPU); and

3). A Heads Up/Mounted Display (HMD) worn by the weapon operator via assault goggles, sunglasses, vision glasses or helmet.

The Camera Module transmits an image to the Operator Module. The Operator Module receives the image data from the Camera Module and overlays a software driven sighting reticle on the video image which is then transmitted to the HMD, thereby providing a field of view to the weapon operator via the HMD. The reticle resides in the Operator Module and not in the Camera Module. As will be explained the reticle is inserted into (superimposed) the video stream by the video electronics. The positioning, etc. is controlled by the hardware but a simple software system allows these hardware parameters to be manipulated and reset as if the reticle was part of a traditional opto-mechanical weapons sight. For this reason the term "software driven" has been adopted.

This reticle can be aligned to the weapon (i.e., ZEROED for both elevation and windage), via the use of ergonomic inputs (i.e., knobs) on the Operator Module thus facilitating accurate target sighting by the operator viewing and aiming the weapon by means of the HMD. By separating the Camera Module from the operator and sighting reticle operator exposure to hostile fire is minimized, for example by allowing sighting or firing around corners without actually allowing any part of the operator's body to extend around the corner.

As Special Operations Forces ("SOF") operators deploy an ever increasing number of sensors for surveillance and operational security, the need to stream real time video (as well as high data rate sensor data) in a secure manner from remote locations becomes increasingly critical. By "secure manner" is meant a method that provides data linkage in a manner that resists interception and blockade without revealing either the origin or the destination of the data. Clearly, under battlefield conditions traditional "wired" connections are totally insecure as well as impractical. Not only can they be readily tapped or cut, they are difficult to establish and readily compromise the secrecy of both the data origin and destination. Radio technology appears to be the answer, but most of the wireless methods for data communication while being easy to establish have the other drawbacks such as readiness of detection and blocking (e.g., jamming the signal).

Specifically, in a weapon sighting system, there is the need to create real time video transmission connectivity with essentially zero latency, and NO wires. An additional use of this type of wireless connectivity is for surveillance of multiple objectives simultaneously. Within the robotics domain the goal is to maintain low latency real time video for robot platforms to enable steering and targeting. To accomplish these operator-driven needs, it is necessary to determine the bandwidth, otherwise known as through-put, for achieving real time streaming video in self-powered, field-able gear utilizing secure technology.

Video Board

The video board occupies a central position in the current device. The video board accepts the video signal from the weapon mounted camera and processes it for viewing on the HMD. It is the video board that enables the weapon-camera combination to be accurately sighted as if a traditional mechanical sight was present. Although others may have experimented with weapon mounted camera systems, hitherto these have been hampered by non-existent sighting systems or by a cobbled together combination of a camera and a traditional opto-mechanical sight. This combination makes it virtually impossible to make sighting adjustments when the weapon system is in actual combat use. It also makes it extremely difficult to move a camera system from weapon to weapon without the need for completely redoing the sighting or "zeroing."

The overall system consists of a video camera which communicates to a computer/electronics modules which processes the raw video signal, inserts an adjustable sighting reticule into the image and then transmits the processed video signal to a display, such as a miniature Head Mounted Display (HMD or HUD (Heads Up Display)) which allows the viewer to see the image and make critical aiming decisions. It is well known in the art that in most cases a video signal from a video camera cannot directly drive a video display—particularly not a digital display such as an LCD (liquid crystal display) or a DLP (digital light processing) display. This is particularly true where the video signal is to be modified—such as through the insertion of a reticule. Commonly some type of "video board" is involved in converting the analog camera video signal to a digital video signal which is compatible with a digital display system. As will be elaborated below, the resulting digital video signal is also ideal for controlled image manipulation—for example superimposition of sighting marks. It should be kept in mind that the term "video board" is merely a simplified term for referring to a particular set of video processing systems. In actuality these could be present on a separate board or part of one or more chips on a single board.

A factor of most video boards capable of making the required conversion and image manipulation is one of video latency. That is to say the process of receiving a frame of video data from the camera, converting it into a digital video frame, storing and manipulating that frame as necessary and outputting it to the display necessarily takes a finite amount of time. There are generally 30 complete video frames per second (each made up of two interlaced fields) so that each frame must be displayed and replaced within 33 milliseconds to maintain a real time display. Video boards may actually take tens of milliseconds or longer to process the first frame; thereafter each frame is processed with the 33 millisecond window. The end result is that the viewer of a "real time" image actually views an image that is delayed by tens of milliseconds or longer (lag time or system latency). In most cases it does not matter that the viewer experiences an image that lags some fractions of a second behind "reality." However, in the aiming of a weapon the lag can become extremely critical. Generally human response to a stimulus requires some 300 to 500 milliseconds. A soldier looking through the sight of a weapon cannot be expected to react to a change in a target in much less than 300 milliseconds—some ten video frames—this is one reason that rapidly moving targets are almost impossible to hit. By the time the soldier has seen the target and pulled the trigger, the target is no longer in the same location. (Of course, a skillful marksman will anticipate the motion and aim for where the target will move.) Imagine the problem if image lag or latency is added to this situation. Suppose the soldier is viewing the target through a video system that adds tens or hundreds of milliseconds of lag. Now the target is not even located where the soldier perceives it to be; the inherent human response time must be added to this system lag so that the latency of the system merely exacerbates the problems of human reaction time. The present inventor has appreciated this problem and solved it by producing a low latency video card (LLVC) having a latency in the low millisecond range—this is, orders of magnitude below the human response factors so that video latency has a negligible influence on the overall system.

As will be explained below the system allows for video processing to insert sighting features. The initial specifications for the system called for keeping video latency below 6 frames (approximately 180 milliseconds). The actual unit can achieve a latency of less than one frame (approximately 33 milliseconds) and still insert the sighting reticle.

The LLVC design features a highly integrated 8051-based high performance microprocessor (CPU) and VLSI complex programmable logic device (CPLD) integrated circuits to provide the video data path and overlay memory. The microprocessor is programmed in C and the programmable VLSI integrated circuits are configured via on-chip flash memory, minimizing the need for external control and configuration. It is this on-chip firmware that implements the insertion of sighting features in a simple manner.

FIG. 1 provides a block diagram of the LLVC. During normal operation of the LLVC (displaying a live video image overlaid with an sighting reticule), the Video Decoder IC 10 digitizes the RS-170 analog video input from C (camera). The video specification employed in the presently preferred implementation is ITU-R BT.656 which is an eight bit luma/chroma video format encoding YCrCb color data 30 frames per second (720 pixels per line and 480 lines per frame). It will be apparent to one of ordinary skill in the art that any of a number of digital video standards can be selected. The digital video stream is passed through the CPLD 20, where each pixel of the video image is checked to see if this pixel should be displayed as a live image or overlaid with a reticule pixel. Information for each pixel about whether a reticule is present, and the reticule shape and color are stored in the video memory 30 (key or alpha channel) associated with the CPLD 20. It is important to appreciate that the CPLD 20 can operate on a pixel by pixel (as opposed to frame by frame) basis. For each pixel the CPLD 20 interrogates the alpha channel memory for that pixel and based on the memory contents determines whether to pass through the actual pixel data (from the camera) or reticule pixel data from the alpha channel location (or another designated memory location) to the output video stream. Replacing an actual video pixel with a reticule pixel (or other special pixel) is determined by the alpha location has the effect of superimposing the alpha channel information (reticule or cross-hair, etc.) over the video image at a set location. Although the system can be used to superimpose video data at any point in the image, the reticule and cross-hair (or other sighting features) tend to occupy only a central portion in the image. This allows a horizontal minimum and maximum and vertical minimum and maximum to be set describing the portion of image where the central superimposition is to occur. With this information the CPLD 20 can interrogate the alpha channel memory only in that smaller region—thus further reducing the time taken to process the superimposition. If a solid reticule (like a spot or square) is to be superimposed in the center of the image, the CPLD 20 could even skip interrogating the alpha channel memory and merely substitute reticule video pixels for the pixels in the defined central region.

Figure 2:
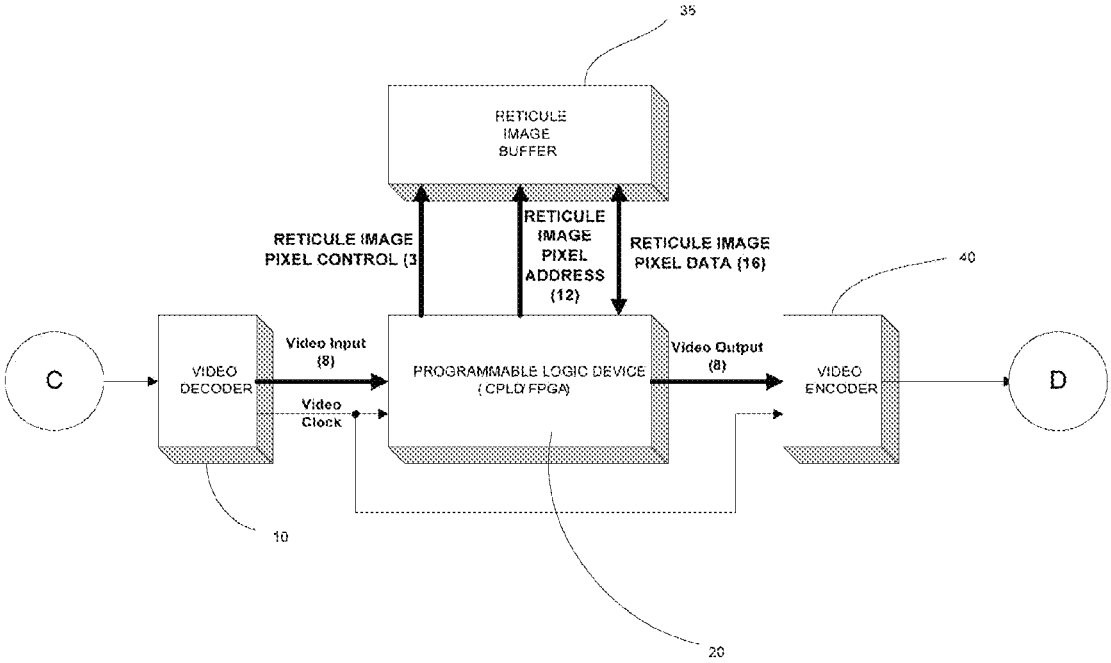
FIG. 2 shows a block diagram of one embodiment of the reticle system.

It will be appreciated that limiting the reticule (including cross-hairs or other implementations) to a central portion of the image could allow one to limit the alpha channel video memory to cover only that region. This enables a greatly simplified layout shown in FIG. 2. In that figure a reticule image buffer 35 replaces the video memory 30. In this implementation the reticule image buffer 35 corresponds only to a central area of the image and the CPLD interrogates only this more limited memory area to determine if pixels in the video image should be replaced by corresponding pixels in the reticule image buffer 35. It will be appreciated that having only a reduced reticule image buffer 35 to interrogate may further reduce latency. This simplified configuration requires a few assumptions that may not always hold. First is that the device always acts by having the CPLD 20 directly pass through the pixels except where the alpha channel data indicate a reticule. In other words, the video memory 30 is used primarily for storing the alpha channel. This approach produces the smallest latency times because the CPLD 20 does not spend time transferring the entire image frame to video memory 30. However, under certain operating conditions interference or other abnormalities may make it desirable to fully buffer the video signal. This requires a full video memory and would not be possible in using a limited video memory or reticule image buffer 35. Second is that the device is never used to superimpose anything other than central reticule/cross-hair information. It will be appreciated that there is considerable utility in having other operating information superimposed around the perimeter of the image. This also militates towards a full sized video buffer.

It will be appreciated that an even simpler system is possible in which the video memory 30 or the reticule image buffer 35 is replaced by a simple set of registers (for example, in the CPLD) which store coordinates indicative of the portion of the image area to be covered by a reticule. In its simplest form the registers could delimit the upper right hand corner and the lower left hand corner of a rectangular reticule. Rather than interrogating alpha memory locations, the CPLD simply replaces the entire range of pixel locations falling within the specified range. This would produce a solid reticule and detail such as cross-hairs would not be available. Another modification of this approach would be to a larger number of coordinate points that would define the outlines of a reticule shape. In this case a start pixel and a stop pixel could be supplied in each line of the image frame. The CPLD would then replace the pixels between the start pixel and stop pixel in each line. Again, these simplifications further reduce latency albeit at the loss of flexibility. Nevertheless, the more complex implementations already have an adequately low latency so that these simplifications are not necessary.

Finally, the composite video image is output to the Video Encoder 40 to generate a composite video (RS-170) or VGA-compatible output signal (at D). The total delay from video input to video output is designed to be less than one frame time. It will be appreciated that the unit can selectively operate in either the CPLD "pass through" mode or in the CPLD video buffer mode to take advantage of different operating conditions. The pass through mode has lower latency but may be less robust and allows only relatively simple solid appearing reticules while the full buffer mode permits complex sighting reticles as well as a large variety of peripheral data displays.

The CPU 50 handles writing of the reticule and updating any reticule or status information. The CPU 50 is responsible for computing the desired location (it will be appreciated that if the camera lens is zoomed, the size of the reticule necessarily changes) of the reticule pixels and inserting appropriate status information in the video memory for display.

It is worth noting that the above design is based on analog NTSC video but can be adapted to other formats (NTSC-<M, J, 4.43>, PAL-<B, D, G, H, I, M, N>, and SECAM) by proper configuration of the decoder and encoder ICs. Additionally, a digital video stream is present at the input and output of the CPLD 20 at the locations marked "A" and "B" in the block diagram. If a digital video stream (CCIR-601 compatible) is available, it can be inserted at "A" and extracted at "B" in the diagram above (to drive a digital video display, for example). Thus, the above design covers all combinations of analog or digital video in and out with only minor modifications.

Other Controls

External inputs and outputs 55 are present within the LLVC design and are made available to the CPU 50. These include:

Switch inputs for reticule calibration to move the reticule up, down, left and right from its current location for reticule zeroing the sight. The new "zero" location is stored in non-volatile memory so that the updated reticule location is preserved across power cycles. As explained below, these inputs are used to directly interact with the firmware to set the reticle during zeroing the sight. However, the firmware is designed to accept commands from a separate standalone program ("WinApp") running on a laptop computer and interfaced through the serial interface connector. This program enables a wide variety of reticle manipulations for debug and development operations.

Orientation inputs that indicate whether the weapon and attached camera are in a normal "upright" position or have been turned on their side.

An On/Off switch that causes the LLVC to enter or exit a low-power "standby" mode.

Analog inputs from the battery and power regulation circuitry for internal monitoring functions.

Diagnostic switch inputs for diagnostic and debugging purposes.

Serial interface connections for CPU debug and programming.

JTAG connector for CPLD debug and programming.

The present implementation of the LLVC is designed as a card that uses a Silicon Labs C8051F120 processor. I/O connectors are present on the board to mate to a Silicon Labs C8051F120DK processor board for development.

Video Memory

The Video Memory is configured as a full-frame memory buffer with a depth of 24 bits. The video decoder decodes an analog video signal to YCrCb 4:2:2 format, which has sixteen bits per pixel. Thus sixteen bits of the video memory bits define a given pixel's luma (Y) value (8 bits) and chroma (Cr or Cb) value (8 bits). This video standard is based on NTSC broadcast color analog standards which reduced overall bandwidth by compressing or suppressing color data. This reduction in color data is achieved by reducing the number of color data pixels in the data stream. Data is transmitted in repeating pixel pairs: YCr YCb. Thus, luma data are provided for each pixel whereas color data (a complete Cr+Cb pair) are provided for a pair of pixels. This has the effect of averaging the color data over two pixels or effectively halving the color bandwidth for each pixel.

The remaining eight bits serve as a key or 'alpha channel' to indicate whether the particular pixel should be replaced (in various options) with the alpha video memory luma and chroma values or passed through unaltered. Use of an eight bit alpha field allows up to 255 different reticule combinations, including opaque reticules, various colored reticules, semi-transparent reticules, and "always visible" reticules. In the test implementation, only opaque reticules (currently red) are supported but the other optional reticules can be made available with suitable firmware programming. As mentioned above the video memory can be depopulated if a smaller set of reticules only are used.

CPU Access to Video Memory

As mentioned, the Video Memory presents 24 bits per pixel to the CPLD device 20. That is 8 bits of luma, 8 bits of chroma and 8 bits of alpha channel. However, access to the Video Memory from the processor is composed of an eight bit access through the I/O Ports via the following signals:

Video Memory Data (8 bits) (alpha channel);

Video Memory Address (11 bits);

Video Memory Control: (4 bits).

Figure 3:
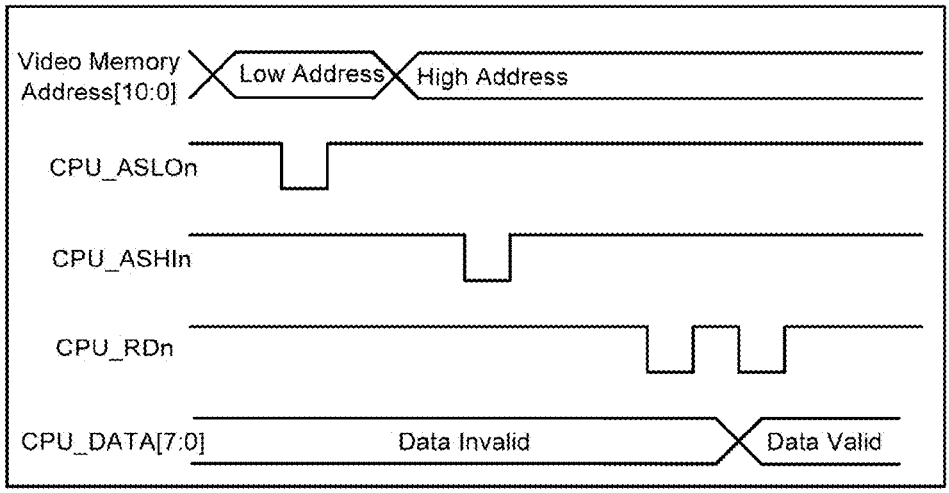
FIG. 3 shows a timing diagram of the processor video memory read cycle.

The Video Memory Address available to the processor is 11 bits wide—the processor must load a full 22 bit address by strobing in 11 bits of the low address and 11 bits of the high address before performing a read or write access on the Video Memory. This multiplexing of the address is required due to processor I/O pin limitations as well as pin limitations on the CPLD part. For example, a read of the Video Memory by the processor is accomplished by loading the low 11 bits of Video Memory address and asserting CPU_ASLOn, then loading the high 11 bits of address and asserting CPU_ASHIn. Once the address has been loaded into the CPLD, the processor must then assert CPU_RDn twice to read the data. It is necessary to execute the read cycle twice because stale data exists in the read pipeline and only the second read obtains valid data. The processor Video Memory read cycle is diagrammed in FIG. 3.

Figure 4:
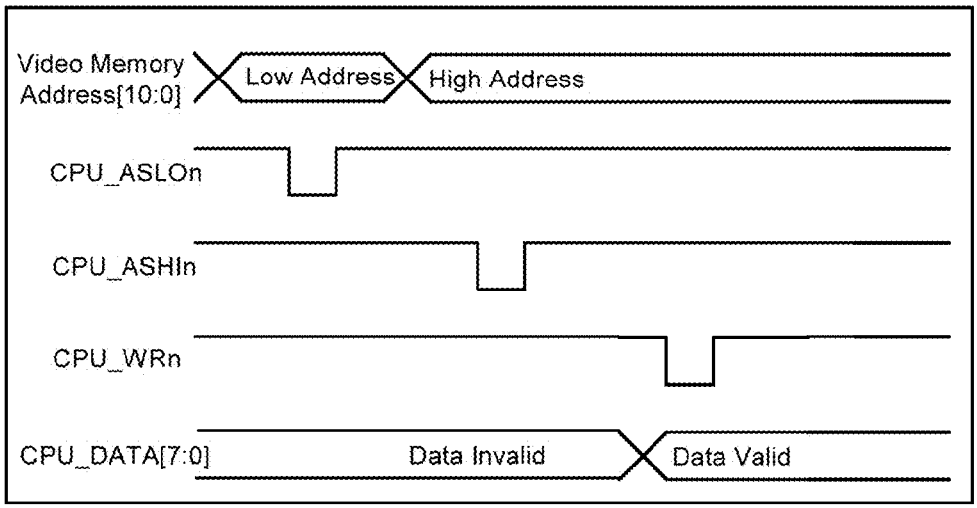
FIG. 4 shows a timing diagram of the processor video memory write cycle.
Figure 5:
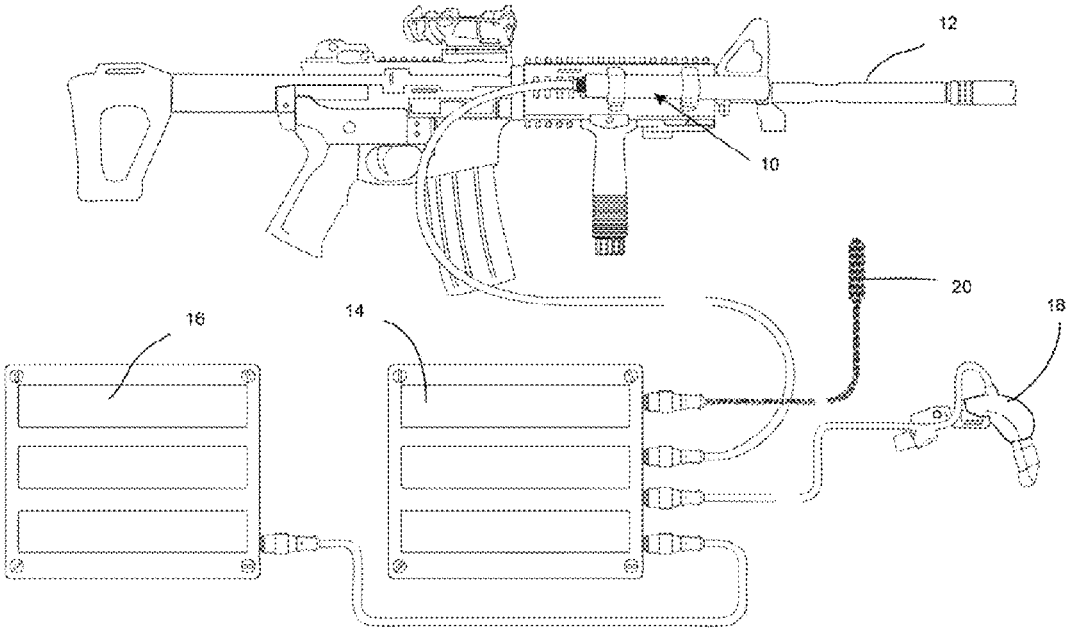
FIG. 5 shows an embodiment of the system with wired connection between the camera and the operator module.

A write of the Video Memory by the processor is accomplished by loading the low 11 bits of Video Memory address and asserting CPU_ASLOn, then loading the high 11 bits of address and asserting CPU_ASHIn. Once the address has been loaded into the CPLD, the processor must load the data in the CPU_DATA port, and then assert CPU_WRn to write the data. The processor Video Memory write cycle is diagrammed in FIG. 4.

Video Memory Address Range and Organization

The Video Memory address range available to the processor appears to be 4 Megabytes long. However, only the low 1.5 Megabytes are actual memory locations—the 4 Megabyte range is due to the requirement of using a multiplexed 11 bit address. The additional 2.5 Megabyte address range is reserved, however.

Video Memory can be thought of as a two-dimensional field where the pixel number comprises the low 10 bits of address and the line number comprises the high 9 bits of address. To the computed 19 bit address one must add the offset into the appropriate memory bank to arrive at the full address. As in most video and graphics applications, the origin <0, 0> is in the upper left corner of the display. Pixel count increases left to right across the display and line count increases from top to bottom down the display. Although <0, 0> pixel is currently the first visible pixel, those of ordinary skill in the art the location of the first visible pixel may change depending on specific video requirements and camera performance.

Initialization

Initialization features continue to be the subject of development and some or all of this information may change depending on details of the implementation. At power-on, the CPLD clears the various video memories by writing invalid values to the luma and chroma memories and clearing the alpha memory. This operation takes two field times (e.g., one frame since each frame consists of two interlaced fields) and occurs after the third and fourth vertical sync signals have been received. Until this initialization step is completed, no video is displayed and the CPU may receive invalid data if attempts are made to read video data. After completing the initialization step, the CPLD sets a flag in a register to indicate that initialization is complete. Thereafter, the CPU can read and write video data at will.

Video Memory Access

Due to characteristics of the video digitization scheme, the minimum size feature that can be written on the display by copying data from video memory is two horizontal pixels in width. This characteristic is due to the encoding of YCrCb 4:2:2 digital video. Each luma pair also requires a chroma pair (Cr and Cb) to be written. As explained above, the chroma bandwidth is reduced by being providing complete Cr and Cb data for each luma pair. A single luma pixel cannot be written because the chroma data would be incomplete. Writing a minimum size feature on the screen requires six write operations: two writes for the even and odd pixel luma value, two writes to write the Cr and Cb chroma pair values for the pixel pair, and two writes to the alpha memory. If other video encoding schemes are employed, (e.g., YCrCb 4:1:1 or YCrCb 4:1:0) the minimum feature size may change and the associated number of writes may change. The minimum feature size will be determined by the cameras employed and the video encoding scheme.

The alpha memory is cleared to all zeroes during power up initialization. A value of 0x00 in the alpha memory indicates that this pixel data is to be passed to the output unchanged. A value of 0xFF in the alpha memory indicates that the data stored in the luma and chroma memories at that pixel is to be output. Other alpha memory values can be used to implement other effect. The reticle is implemented by writing the luma and chroma characteristics of the reticle to the "correct" position of the alpha memory (see "Zeroing the Sight" below.

Care should be taken to write valid values into the luma and chroma memories. Invalid values of luma and chroma can create problems on the output video encoder. Valid ranges for the current encoder are: Luma=0x10 to 0xEB (inclusive) and Chroma=0x20 to 0xF0 (inclusive).

Zeroing the Sight

At initiation the reticle shape, position, chroma and luma values are written to the alpha memory as explained immediately above. The reticle shape and chroma and luma values are stored in the firmware memory and a variety of different reticle types can be selected. A cross-hair or a central "red dot" are popular selections. As mentioned earlier, the actual position of the reticle is stored in non-volatile memory. That is, the first time the unit is energized the selected reticle is written into memory at a default location. The weapon is then zeroed or "aligned" much like the alignment of a traditional opto-mechanical sight. The weapon is fired at a target and the operator compares the position that the bullet strikes the target with the position of the reticle in the image. Ideally, the reticle and the bullet strike position should be exactly coincident. The camera is mounted to the weapon on standard optical rails similar to those occupied by a traditional sight. The camera is mechanically aligned to be as close as possible to true center. The rails allow the camera to be moved from weapon to weapon without altering the sighting (to the extent that rail alignment is identical from weapon to weapon). The actual firing test of the weapon will likely indicate that the camera is not perfectly aligned. This relatively small amount of misalignment is removed by shifting the position of the reticle. In a traditional sight this would occur by manipulating mechanical controls on the sight that mechanically change the alignment of the sight. With the present invention, electronic controls (i.e., knobs attached to potentiometers) are manipulated on the operator module (CPU) to move the reticle until it exactly coincides with the bullet strike position on the target.

This adjustment is not mechanical. Instead the system firmware interprets changes in the potentiometer values as pixel positions for the reticle so that the reticle can be moved up and down as necessary. This software is not at all complex and consists merely of scaling the range of the potentiometer or similar control to the number of pixels in a given display direction. For example, the display has 720 horizontal pixels and if the entire range of the potentiometer controlling the horizontal position was 7200 ohms, a change of ten ohms would move the reticle one pixel. As the reticle is moved, its new position is constantly recorded in non-volatile memory so that next time the unit is energized the reticle will automatically appear at the "zeroed" position determined by comparison to the bullet strike position.

This zeroing system also has other uses during functioning of the system. First, the camera is equipped with a zoom system so that the operator can "zoom in" to see target details more clearly. Optical zooming systems and to a larger extent electronic zooming systems do not always remain perfectly optically centered during the zooming process. Fortunately, this non-linearity is consistent and reproducible. When the camera is zoomed, the zoom amount is constantly transmitted to the CPU. Based on predetermined non-linearity factors derived from testing the zoom, the CPU adjusts the reticle position to overcome the non-linearity. This means that the relationship between a given image feature and the reticle remain the same even as the image feature magnification zooms and the position of the feature in the video frame shifts.

Finally, the reticle adjustment system can be used to accommodate the use of orientation sensors. When a weapon is held at arms-length and around a corner, it may be convenient to rotate the weapon 90° or more. This causes the image in the HMD to switch into a disorienting aspect. It is relatively difficult to deal with a "cockeyed" image position in the HMD. Therefore, the camera contains orientation sensors to tell the CPU when the camera is rotated 90° or more. The system responds by counter rotating the video image so that it appears upright in the HMD. However, there is a non-linearity introduced because the horizontal and vertical pixel numbers are not identical. The rotation software automatically introduces a correction into the reticle position so that rotation does not negate sight zeroing. All these manipulations are enabled by the simple alpha channel mapping system explained above.

Streaming Video

Currently, streaming video is available for use in vehicles and satellites with the bandwidth and power to stream real time video via a wireless connectivity. However, in the field, at the operator's level, there is currently little ability to accomplish this desired task with secure technology in man-portable mil-spec equipment, such as weapon sighting systems and real time surveillance sensors and robotic guidance systems. Many commonly available radio technologies are not adequate. Blue tooth with its low power frequency hopping 1 megahertz ("MHz") band has capacity to stream only low quality (VHS type) video, and its limited range removes it from consideration for the missions at hand. While IEEE 802.11 technologies have demonstrated the ability to stream video of various qualities, these systems are power hungry and their lack of frequency hopping or spread spectrum transmission renders then stealth-less and insecure—that is, easy to trace and intercept. Currently employed connectivity in the MHz band does not employ spread spectrum and is not secure because it can be directionally found ("DF"). This is NOT acceptable for operational deployment because the location of the operator would be revealed as soon as the system was activated.

However, other technical formats are emerging which can move real time streaming video or other data with the desired bandwidth. In the gigahertz ("GHz") frequency spectrum there are technical solutions which have the ability to achieve high data rate, streaming video. The GHz bandwidth solution offers the potential to stream real time video, all the while employing spread spectrum (multiple frequency) ultra-wide band (UWB) transmission to achieve secure connectivity for wireless streaming video and data transmission. To DF equipment, the detected signal signature looks like white noise, and cannot be readily triangulated, thereby ensuring the secrecy of SOF operators. The general low power nature of the connectivity not only enhances security but also extends the life of operator-worn power sources (e.g., batteries).

I have found that the solution for creating a wireless man-portable connectivity is the integration of gigahertz frequency components which will accomplish a low power, high resolution and high bandwidth link with more than 1 Mbps throughput. This technology has both military and commercial applications, for example Special Operations Forces, Marine Corps and Law Enforcement applications.

The present invention includes a video processing system particularly adapted for smart weapons systems such as weapon mounted video cameras for weapon aiming. Safety of military personnel can be enhanced by providing a weapons-camera system that permits accurate aiming of a weapon with a barrier interposed between the personnel and oncoming fire. Normally, it would be necessary for a weapon operator's head to be exposed but a weapon mounted camera transmitting its image to a miniature display worn on the operator's head makes safe aiming possible.

For such a system to operate correctly it is necessary to process the video signal for proper display on the operator-worn display. Part of the processing is inserting a reticule or other sighting clues into the image so that the operator can accurately aim the weapon using only the video image. A hitherto underappreciated problem with most video processing systems is that of video latency. The conversion and display of the video image—particularly if the image is to be manipulated to insert sighting clues, etc.—takes a finite amount of time. Usually we think of a video image as showing "real time" but in truth the image lags as much as a few seconds behind reality. For video entertainment purposes and even for most remote surveillance purposes a lag of a few seconds is inconsequential. However, when attempting to aim a weapon by means of a video image, video latency can be an insurmountable problem. If the desired target is moving, video latency will cause the operator to point the weapon not at the target but where the target was in the past. Even if the weapon is kept stationary waiting for an unfortunate target to cross the sights, video latency can result in the weapon being fired not when the target is "in the cross-hairs" but when the target has already moved on.

Therefore, it is important for video latency to be kept well below the shortest possible human response time. The present invention uses a combination of high speed microprocessor, high speed complex programmable logic device (CPLD) and memory with high speed video coders and decoders to keep latency below one video frame (about 33 milliseconds) which is well below human response time. An analog video data stream is converted into digital video and processed pixel-wise by the CPLD. In one low latency mode video memory key or "alpha channel" memory information indicates the location of the sighting reticule or other sighting indicators. If the alpha channel memory location for a given pixel is "empty," then the CPLD rapidly passes on the original video pixel for that location to the video encoder for output to a display. That is, if the alpha channel memory locations for all the pixels are "empty," the CPLD directly passes on the data to the video output encoder. If however, a given alpha pixel is not empty, that pixel is replaced by the contents of the rest of the video memory at that location. If the sighting clues are limited in a restricted portion of the image, the CPLD can be programmed to consider the alpha memories only within that restricted portion of the image—thereby increasing processing speed.

Because the system has a complete video buffer, it is also possible for the CPLD to store an entire video frame or even successive frames in memory. Although this process necessarily increases latency, it allows sophisticated comparisons between frames to allow for automated target detection, etc. Nevertheless, because of the rapid pass through of video data to the output encoders, latency can always be kept well below levels that impact aiming performance or human response.

To review: the key components of the inventive device include:

1). A weapon mounted camera module, comprising a real time imaging device with auto-focus, auto-exposure, and zoom capability, and a system for communicating the weapon's field of view as captured by the camera module to 2). the waterproof operator module which is operator borne with an attached power source and a waterproof HMD for allowing the weapon operator to view, sight and fire on hostile targets.

Figure 6:
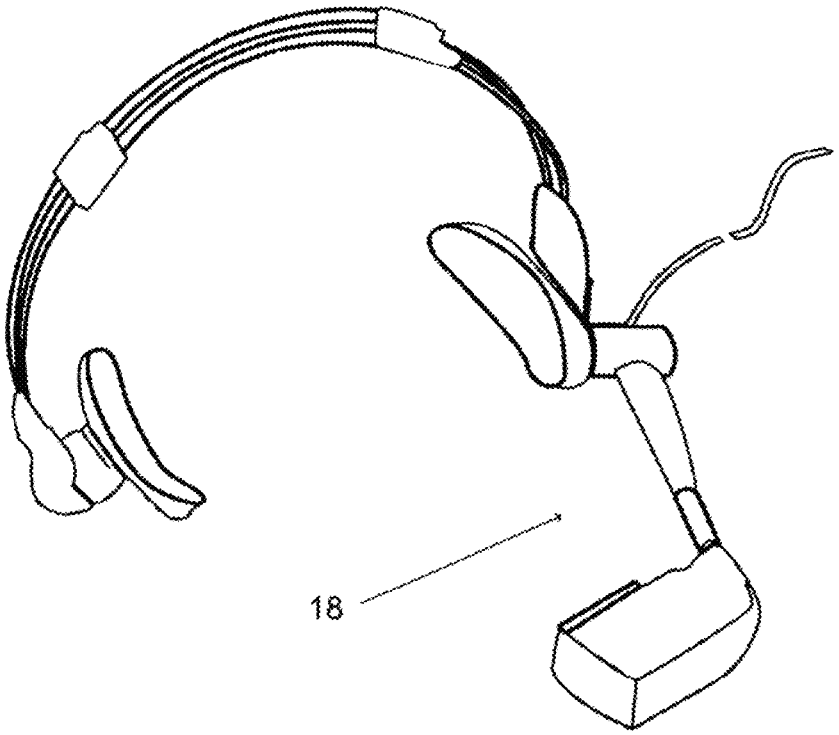
FIG. 6 shows a detailed view of an HMD.

FIG. 6 shows the waterproof remote camera module 10 mounted on a weapon 12. The camera module 10 provides a viewing system that communicates real-time image data to the operator module (CPU module) 14 which is attached to a power source (battery pack) 16 both of which are worn or carried by the weapon operator. This combination significantly minimizes operator exposure to hostile fire. The operator module 14 provides a software-controlled sighting reticle that is overlaid on the weapon's field of view. The reticle can be calibrated and aligned with the weapon using an input 20 and receives real time image data from the camera module 10. In this way the real time image with the reticle is displayed by the wired HMD 18 so that the operator can see the weapon's field of view without being exposed to hostile fire. FIG. 6 provides a more detailed view of the HMD. Normally, image encoding ensures that the Camera Module image data can be received by only one Operator Module. However, an alternate form of image encoding can ensure that the Camera Module image data may be received by a specific number of Operator Modules; for example, in the case of military intelligence and command and control.

Additional capability within the Operator Module can provide, by way of example and without limitation, target identification, target ranging data, GPS (global positioning system) coordinates, friend/foe determination and device status information.

Currently there are very few, if any, chipsets (commercial or otherwise) for use effective by the military operators in the SOF theater of operations. Part of the current invention is a functional, wireless real time streaming video on a man-portable, computer driven, weapons sighting platform surveillance system along with appropriate miniature electronics. This allows connectivity using an ultra-wide band (UWB) spread spectrum transceiver in the GHz spectrum for use in a man-portable, worn on the operator, CPU driven, weapons sighting platforms and surveillance systems. This invention greatly enhances, augments and exploits the war fighter's ability to make critical decisions based on real time streaming video, a capability not currently achievable. Operational security will be dramatically improved along with surveillance intelligence gathered from deployed remote sensors. No longer will the operator have to be directly at risk by gathering still images because the ability to remotely view real time streaming video will create a collapse in the decision-making time aspect of deployment, i.e., quicker decisions on objectives. This invention allows the operator to view alternatively gathered intelligence via the newly integrated wireless connectivity for streaming real time video to a wearable computer-heads up display combination (CPU/HUD).

Figure 7A:
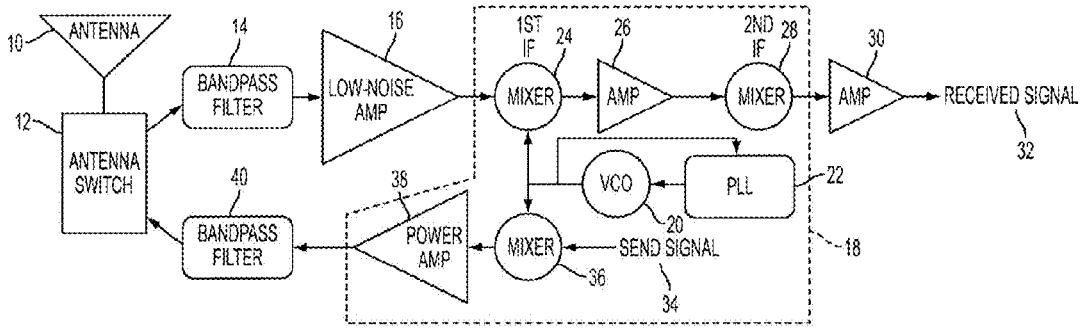
FIG. 7 is a diagram comparing traditional transceivers (FIG. 7A) with ultra wideband (FIG. 7B) transceivers.
Figure 7B:
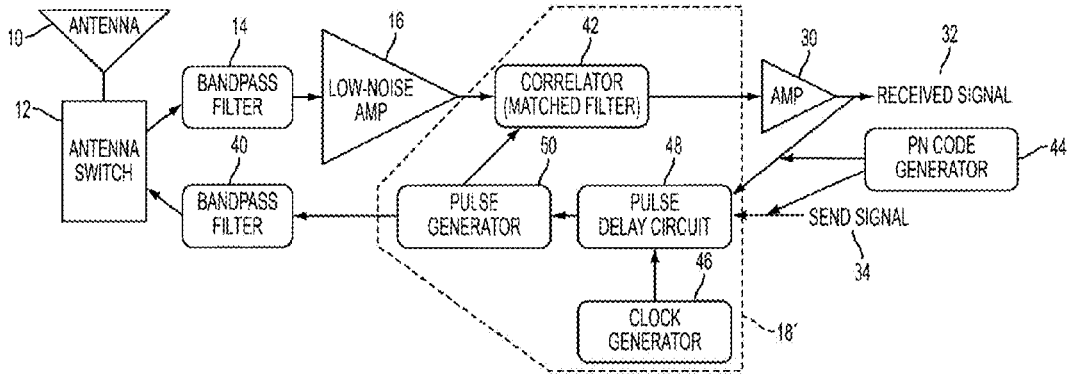

The preferred transceiver employs ultra-wideband (UWB) spread spectrum technology (pulse transmission without carrier frequency). However, ultra wideband results can also be achieved by using frequency hopping or shifting over a huge bandwidth; therefore, UWB as used herein can refer to either approach provided the resulting signal is spread over a wide bandwidth so as to resemble white noise. Although the GHz UWB solution is technologically more advanced than traditional transceivers, the actual implementation may actually involve simplification (in terms of circuit fabrication) as compared to traditional electronics. FIG. 7 contrasts the block diagrams of a traditional transceiver (FIG. 7A) with a spread spectrum or ultra-wideband transceiver (FIG. 7B). Many of the circuit blocks are shared between the two technologies. Of course, because of the differences in frequencies employed, the exact size and type of electrical components to achieve a given function differs somewhat from one application to the other. At the left side of the diagrams an antenna 10 is provided to transmit and receive radio waves. An antenna switch 12 is provided to switch from reception to transmission. In the reception mode portion of the circuit a bandpass filter 14 is provided to eliminate those parts of the radio spectrum that are not of interest. The signal passing the bandpass filter 14 is amplified by a Low-noise amplifier 16 and passed to the demodulation/modulation portion 18 of the circuit.

In the traditional transceiver (FIG. 7A) the demodulation/modulation portion 18 contains a local oscillator in the form of a voltage controlled oscillator (VCO) 20 and a phase locked loop (PLL) 22. This arrangement is used to recover the signal from a carrier frequency. The local oscillator frequency is combined with the signal (containing the data and the carrier frequency) in the mixer 24 of a first intermediate frequency (IF) stage. The resulting signal is selectively amplified by an amplifier 26 and that signal is combined with the oscillator frequency in the mixer 28 of the second IF stage to yield a final signal which is amplified by an amplifier 30 to yield the received signal 32. Here a superhetrodyne process is used to demodulate the signal (i.e. recover the data signal from the carrier frequency). The same process is used in reverse to transmit the send signal 34 which signal is combined with the oscillator frequency in a mixer 36. The resulting higher frequency signal is amplified by a power amplifier 40 and sent by the antenna switch 12 to the antenna 10.

The ultra-wideband transceiver (FIG. 7B) shares many of these same components. However, the "demodulation/modulation" portion 18' is different because no carrier frequency is involved and the process uses digital components. A pulse generator is used directly to create a transmission signal having no carrier frequency. A pulse code pattern is modulated according to the data to be transmitted. Following is a simplified explanation: an incoming pulse signal from the Low-noise amplifier 16 is processed by a digital correlator (matched filter) 42 to recover the original data which are amplified by the amplifier 30 to yield the received signal 32 (which may undergo further decoding). The correlator 42 is driven by a pulse code signal identical to the original pulse code used to modulate the signal received by the antenna 10. The PN (pseudorandom number) code generator 44 recreates the original pulse pattern which is combined with a portion of the received signal, delayed by the pulse delay circuit 48 (which is controlled by the clock generator 46) and the resulting pulse train is fed back to the correlator 42 to recover only those signals modulated according to the original PN code pattern. The pseudorandom aspect of the code ensures that the resulting signal will look like white noise. For modulation purposes the PN code from PN code generator 44 are combined with the send signal 34, delayed by the Pulse delay circuit 48 and used to drive the Pulse generator 50. The resulting high power pulse signal is filtered (Bandpass filter 40) and applied to the antenna 10 for transmission. The transmitted pulse signal looks like white noise over a spread spectrum and access to the correct PN code is necessary to demodulate the signal.

Figure 8:
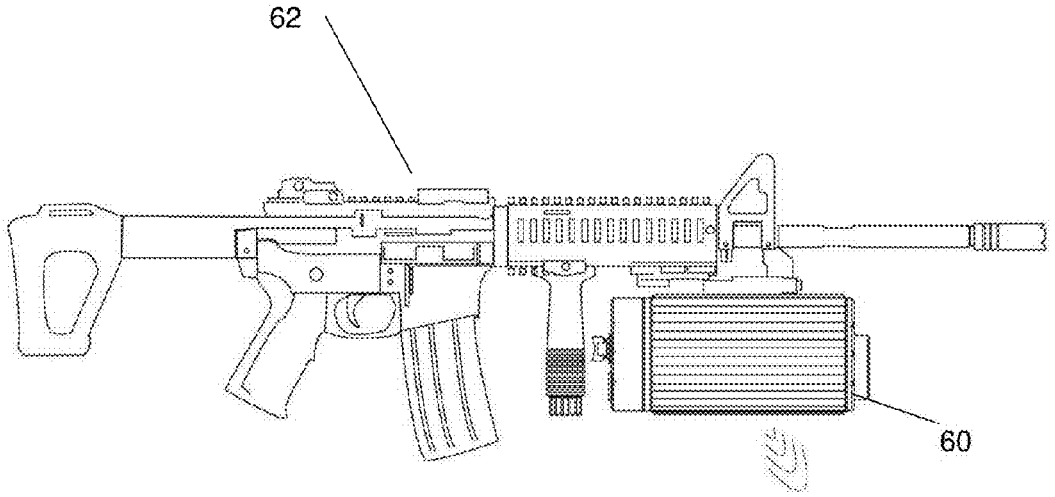
FIG. 8 is a diagram of a weapon equipped with a video camera.
Figure 9:
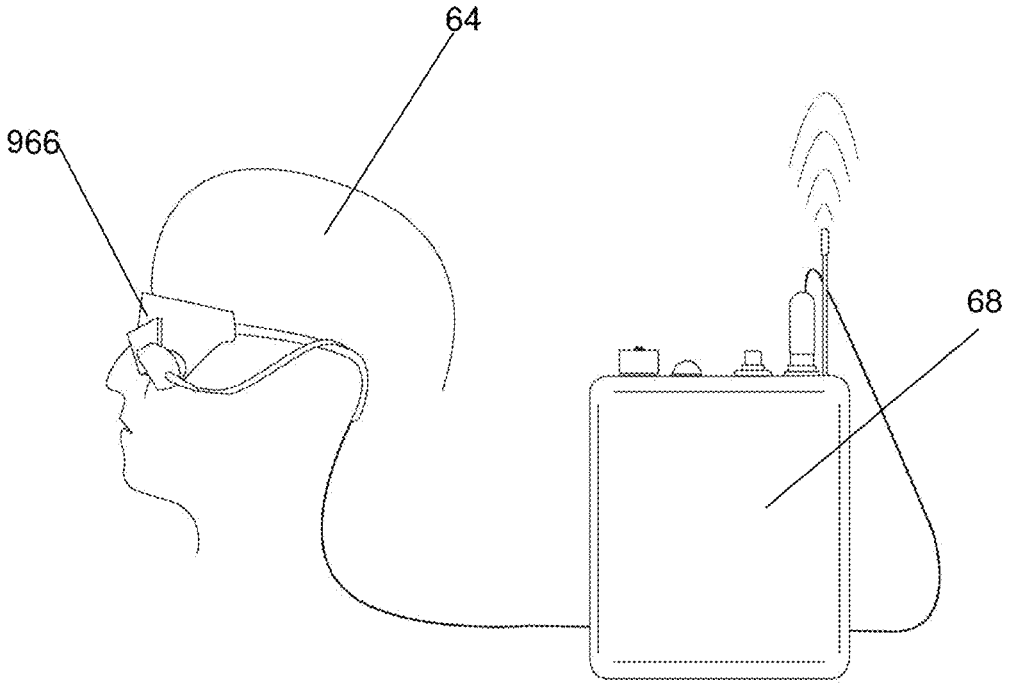
FIG. 9 is diagram of a computer system for receiving the output of the video camera of FIG. 2 and displaying it by means of an operator worn display unit.

This type of transmission system allows extremely high data rate transmission over a short range with very little power consumption. Range can be increased by reducing data rate and/or increasing power. The remote weapon site shown in FIG. 8 is a major use for this type of transmission. A site camera 60 is attached to a weapon 62. The camera transmits the weapon aiming visual information by means of UWB to a weapon operator. This allows the operator to remain protected by a barricade, etc. while still being able to aim the weapon 62. FIG. 9 diagrammatically shows the operator 64 wearing a heads-up display (HUD) 66. This video display allows the operator 64 to view the image transmitter from the camera 60. The HUD 66 is powered by and received data from a wearable CPU unit 68. The CPU unit 68 contains a UWB receiver, batteries and a data processor to process the video and other data. In addition, the CPU unit 68 can be equipped with a UWB transmitter to transmit data to more remote command posts as well as receive data from the command post and to/from a variety of remote sensors as well as other CPU units worn by other nearby operators.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. A remote weapon mounted sighting and viewing system comprising:

a.) a camera module mounted to a weapon for capturing a video image of a field of view of the weapon;

b.) a transmitter for transmitting the video image in real time;

c.) An operator module for receiving the video image transmitted by the camera module and for communicating the video image wherein the operator module uses a computer driven video system to insert a sighting reticule into the video image;

d.) A head mounted display for receiving the image from the operator module and displaying the image including the sighting reticule to a weapon operator, e.) Inputs that allow the weapon operator to adjust the positioning of the reticule relative to a bullet strike to align and zero the sighting system so that the weapon operator may accurately aim and fire the weapon using the displayed video image; and f.) Wherein as the reticule is moved, its new position is constantly recorded in a non-volatile memory so that next time the operator module is energized the reticule will automatically appear at the zeroed position as determined by comparison to a bullet strike position.

2. A remote weapon mounted sighting and viewing system of claim 1 further comprising: wherein the camera module includes zoom system for zooming in to determine target details.

3. A remote weapon mounted sighting and viewing system of claim 1 further comprising: the sighting and viewing system is mounted on a weapon.

4. A remote weapon mounted sighting and viewing system of claim 1 further comprising: wherein the operator module is attached to a power source that is battery pack.

* * * * *